US012741183B2

(12) United States Patent
Henning

(10) Patent No.: US 12,741,183 B2
(45) Date of Patent: Sep. 22, 2026

(54) THROWING GAME ASSEMBLY AND METHOD OF GAME PLAY

(71) Applicant: Branden Henning, Shaker Heights, OH (US)

(72) Inventor: Branden Henning, Shaker Heights, OH (US)

( * ) Notice: Subject to any disclaimer, the term of this patent is extended or adjusted under 35 U.S.C. 154(b) by 310 days.

(21) Appl. No.: 18/585,580

(22) Filed: Feb. 23, 2024

(65) Prior Publication Data

US 2024/0286017 A1 Aug. 29, 2024

Related U.S. Application Data

(60) Provisional application No. 63/448,464, filed on Feb. 27, 2023.

(51) Int. Cl.
*A63B 63/08* (2006.01)

(52) U.S. Cl.
CPC ..... *A63B 63/08* (2013.01); *A63B 2210/50* (2013.01)

(58) Field of Classification Search
CPC ..... A63B 67/06; A63B 63/00; A63B 63/008; A63B 63/08; A63B 57/40
See application file for complete search history.

(56) References Cited

U.S. PATENT DOCUMENTS 1,862,462 A * 6/1932 Boyd ..... A63B 63/00 473/190
3,484,109 A * 12/1969 Dahlberg ..... A63B 63/00 473/166
3,490,769 A * 1/1970 Torbett ..... A63B 63/007 473/196
D392,333 S * 3/1998 Griggle ..... D21/303
D429,303 S * 8/2000 Peterson, Jr. ..... D21/790
7,066,824 B2 * 6/2006 Wenzler ..... A63B 69/3623 473/196
7,401,785 B1 7/2008 Waite
2004/0214648 A1 * 10/2004 Simpson ..... A63B 69/3691 473/172
2005/0006846 A1 * 1/2005 Roy ..... A63B 67/06 273/336
2010/0320692 A1 * 12/2010 Tookey ..... A63B 63/08 273/398
2012/0049458 A1 * 3/2012 Yokie ..... A63B 67/06 273/350

FOREIGN PATENT DOCUMENTS

FR 2651141 A * 3/1991 ..... A63B 63/00

* cited by examiner

*Primary Examiner* — Joshua T Kennedy
(74) *Attorney, Agent, or Firm* — Chrisman Gallo Tochtrop LLC

(57) ABSTRACT

A game assembly includes a stand and a frame attached to the stand. A plurality of arms extend radially from an upper end of the stand and are adapted to support a hoop assembly therefrom. Each of the plurality of arms includes a plurality of tines extending upwardly therefrom. The hoop assembly includes a plurality of hoops spaced concentrically and substantially perpendicular to a common vertical axis. The hoop assembly is substantially planar to a support surface. Each of the plurality of hoops is attached to a respective one of the plurality of tines and is adapted to suspend a scoring receptacle therefrom. Said scoring receptacle defining a plurality of scoring zones for a throwing game.

20 Claims, 9 Drawing Sheets

THROWING GAME ASSEMBLY AND METHOD OF GAME PLAY

CROSS-REFERENCE TO RELATED APPLICATION

Benefit of U.S. Provisional Patent Application Ser. No. 63/448,464, filed Feb. 27, 2023, is hereby claimed, the disclosure of which is hereby incorporated herein by reference.

FIELD OF THE INVENTION

This application generally relates to a game assembly, and more particularly a game assembly including a plurality of hoops demarcating scoring regions for a throwing game.

BACKGROUND OF THE INVENTION

Throwing and tossing games have become increasingly popular as an outdoor entertainment option, for example, at backyard gatherings, tailgate parties, or vacations at the beach. Many throwing and tossing games require players (individually or grouped in teams) to toss or throw projectiles toward a target (e.g., a basket, a bucket, or a board) to accumulate points. Yet, a need exists for new throwing games that offer variety to make outdoor events more engaging. Therefore, it is desirable to have a new game assembly to facilitate a new type of throwing game. In particular, it is desirable to have games utilizing different methods of throwing or tossing, board configurations, and rules for backyard entertainment to continue to evolve.

BRIEF DESCRIPTION OF THE DRAWINGS

These and other features, aspects and advantages of the present disclosure can be further understood when read with reference to the accompanying drawings.

DETAILED DESCRIPTION

Figure 1:
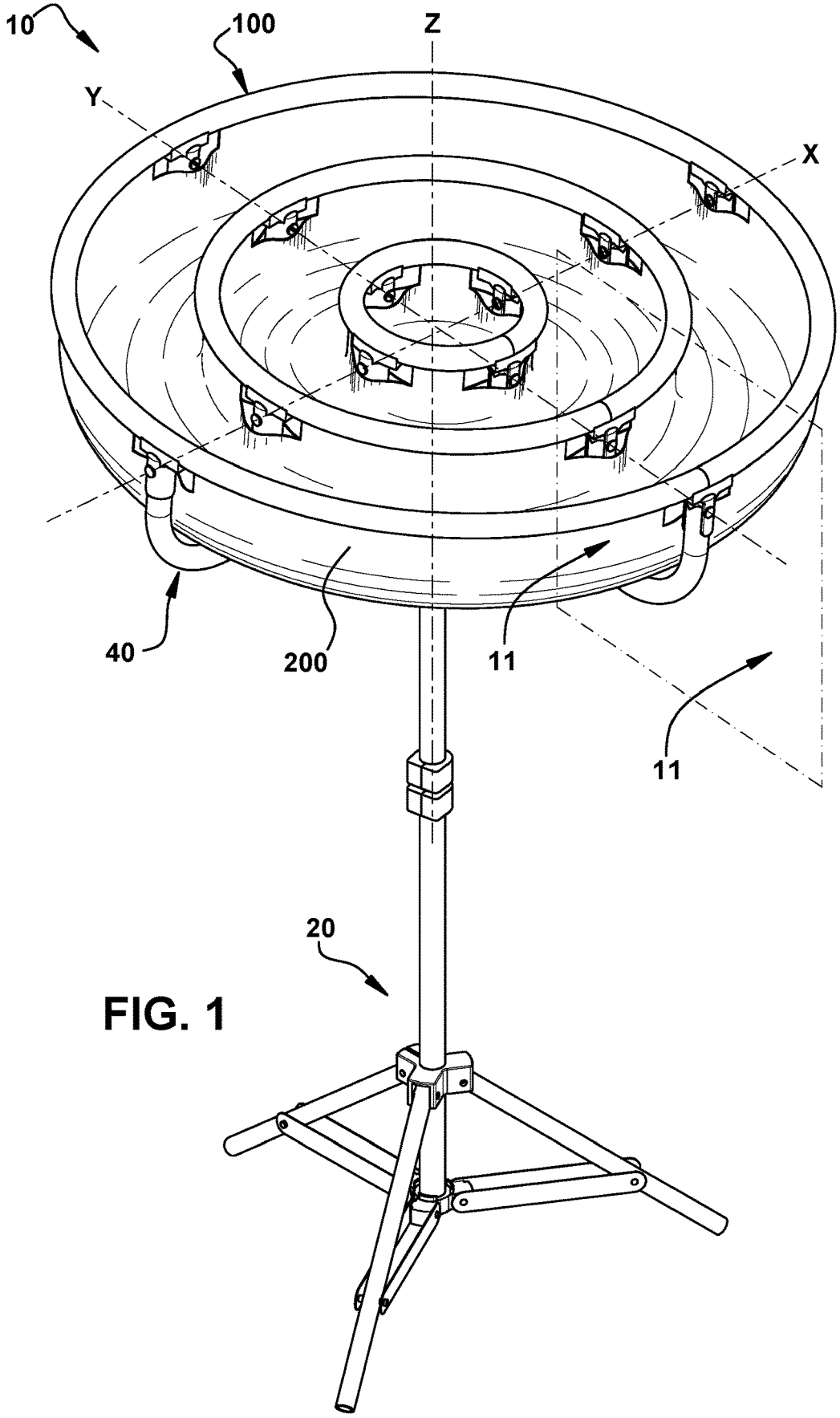
FIG. 1 is a top perspective view of an example throwing game assembly.

Apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

Herein, the term "substantially," and variations thereof are intended to denote that the described features are equal or approximately equal to a value or characteristic, as desired, reflecting tolerances, conversion factors, rounding off, measurement error and the like, and other factors. For example, the term "substantially circular" is intended to denote a structural element that is circular or approximately circular. As another example, the terms "substantially," and variations thereof can denote values or characteristics that are exact or within 10% of exact, for example within 5% of exact, or within 2% of exact.

Referring now to FIG. 1, an example throwing game assembly 10 according to the present disclosure is shown in relation to three orthogonal axis x, y, and z. In general, the throwing game assembly 10 includes a stand 20, a frame 40, and a hoop assembly 100 configured to receive projectiles thrown or tossed by players during a throwing game, as discussed in detail below.

Figure 2:
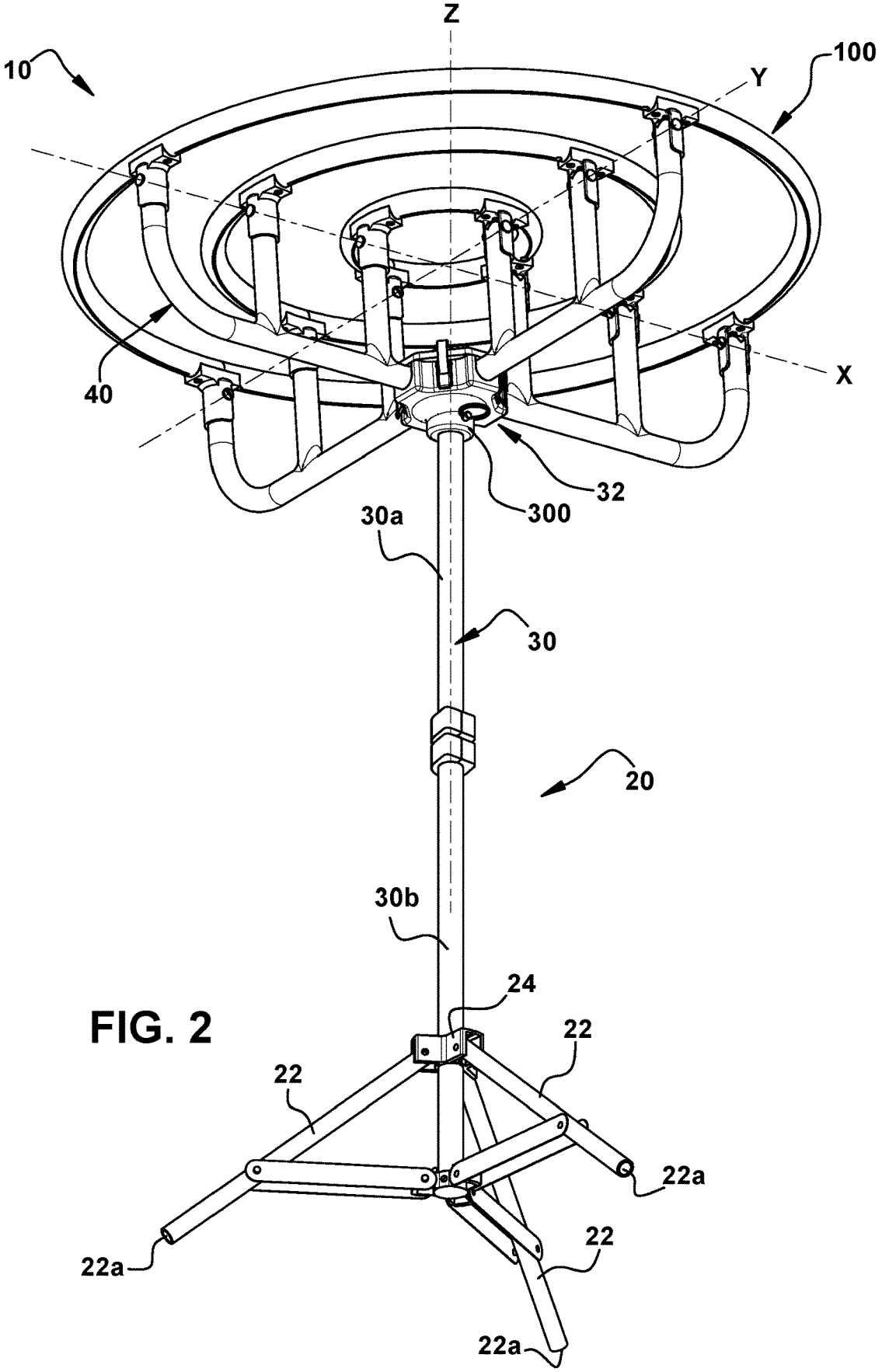
FIG. 2 is a bottom perspective view of the throwing game assembly of FIG. 1 with a scoring receptacle thereof removed for clarity.

Referring to FIG. 2, the stand 20 is adapted to rest on a support surface (e.g., a lawn, a concrete driveway, or a floor) and elevate the hoop assembly 100 therefrom. Preferably, the hoop assembly 100 is elevated from the support surface to encourage an upward shooting/throwing motion and make retrieving game bags received by the hoop assembly 100 easier for the user (e.g., more ergonomic). For this purpose, the height is preferably between 2 feet to 5 feet therefrom, and more preferably 3 to 4 feet therefrom.

In the illustrated example, the stand 20 is depicted as a tripod including a column 30 and three legs 22 extending downwardly at an acute angle relative to the column 30. Although, it should be appreciated that the stand 20 may take on other forms without departing from the scope of the present disclosure. For instance, the number of legs 22 and/or inclination of the legs 22 may differ from that shown. For example, in some embodiments there may be two or four legs, and/or the legs 22 may extend at another angle (e.g., 90°) relative to the column 30. In some embodiments, it is contemplated that the stand 20 may embody a monopod including a single leg (not shown) adapted to engage a support surface (e.g., with a spike extending therefrom). It is also contemplated that a distal end 22*a* (FIG. 2) of each leg 22 may comprise a high friction material (e.g., a rubber or silicone foot) to prevent the legs 22 from slipping relative to the ground surface (e.g., a wooden floor), or a planar element adapted to support the throwing game assembly 10 upon a malleable surface such as sand. In this manner, it is contemplated that the stand may be adapted for use on a wide variety of support surfaces, e.g., indoor floors, lawns, concrete or paved surfaces, or sand.

In the present example, the column 30 is connected to the legs 22 via a junction or coupling 24. Preferably, the column 30 is a telescoping assembly including at least one telescopic member 30*a* configured to be received by another telescopic member 30*b* to variably adjust the height of the hoop assembly 100.

An upper end 30*c* of the column 30 includes a hub 32 that is adapted to vertically support the frame 40 therefrom. In some embodiments, it is contemplated that the hub 32 may constitute a part of the stand 20 (e.g., integrally formed therewith or fastened/clamped thereto). In other embodiments, it is contemplated that the hub 32 may constitute a part of the frame 40 e.g., integrally formed therewith or fastened/clamped thereto.

Figure 3:
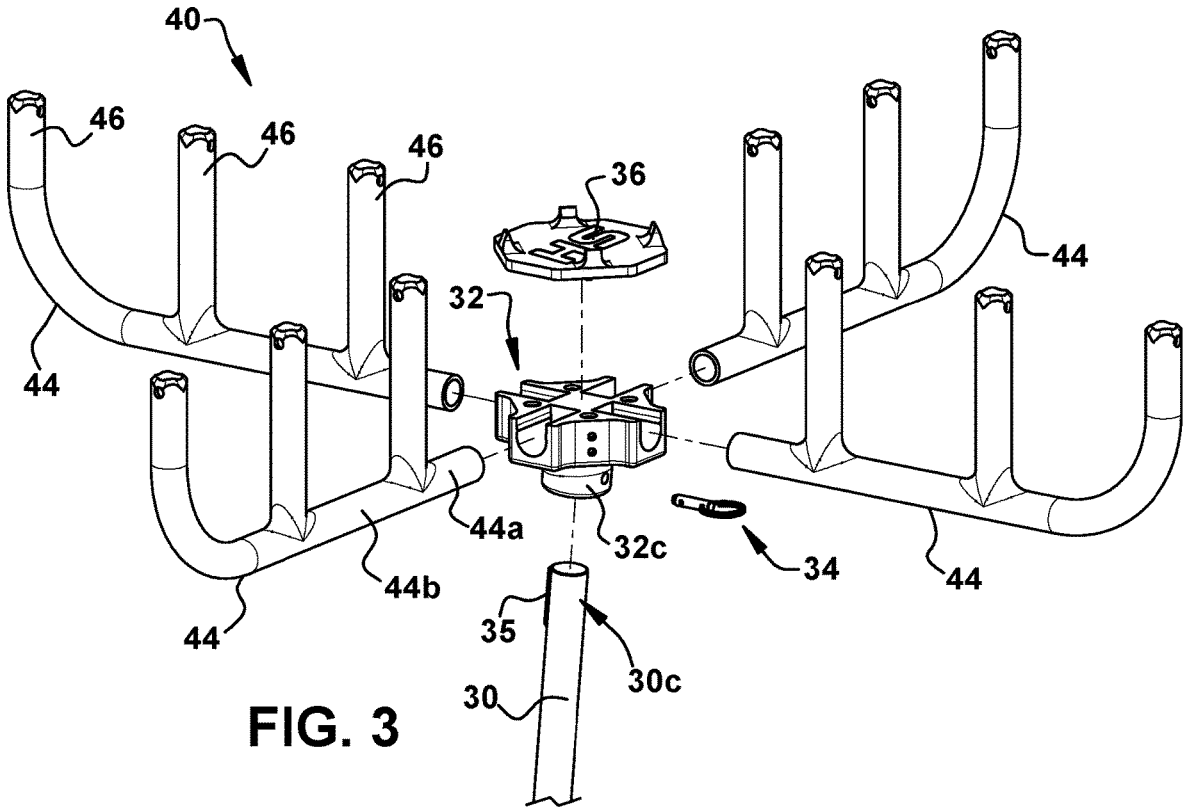
FIG. 3 is an exploded, perspective view of an example frame and hub of the throwing game assembly.
Figure 4:
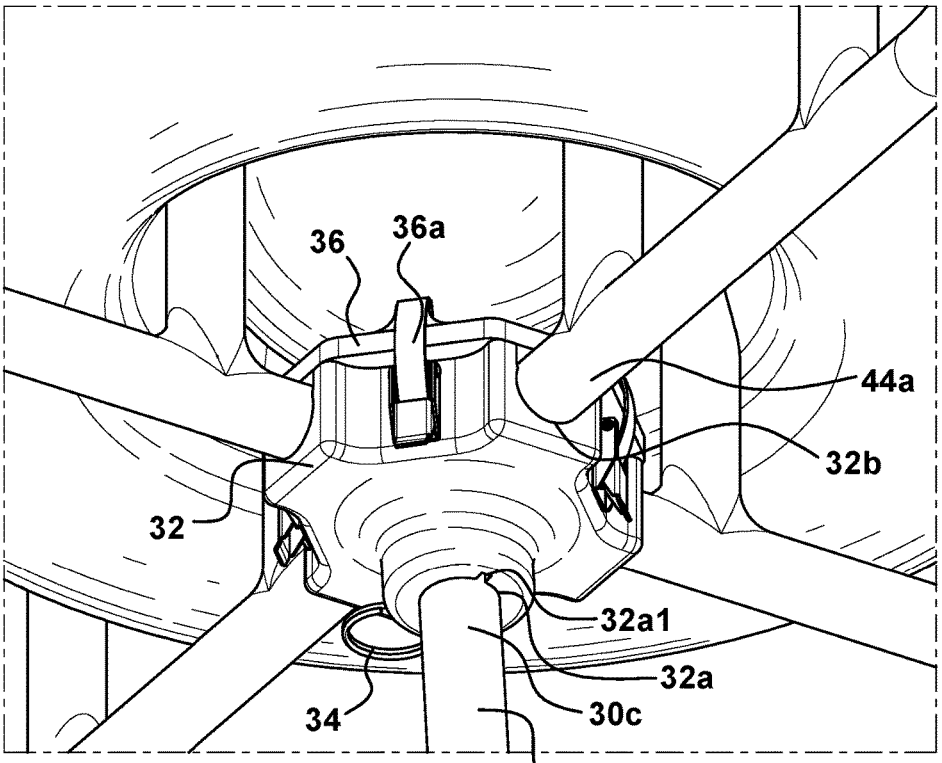
FIG. 4 is a closeup, perspective view of the hub with arms of the frame connected thereto.

As shown in FIGS. 3 and 4, a pin 34 may be used to connect the stand 20 (FIGS. 1 and 2) to the hub 32. Specifically, the upper end 30*c* of the column 30 is inserted into a blind hole 32*a* formed in a lower surface of the hub 32. The upper end 30*c* of the column 30 includes a projection 35 that is aligned with a notch 32*al* in the blind hole 32*a*. The pin 34 is inserted into a hole 32*c* within the hub 32 and aligns with an indentation made in the upper end 30*c* of the column 30.

However, it is contemplated that the hub 32 may be attached to the column 30 in a variety of different ways, for example, via the use of magnets or fasteners (e.g., resilient clips or snaps, screws, nuts, bolts, adapters, or any other suitable attachment means).

Referring to FIG. 3, the hub 32 defines a plurality of equidistant slots 32*b* (spaced apart by 90° when viewed along the z-axis) that extend radially from a center of the hub 32 coinciding with the z-axis. Each slot 32*b* is shaped and dimensioned to receive a proximal end 44*a* of a respective arm 44 of the frame 40, i.e., in a state wherein the arms are vertically extended (see, e.g., FIG. 6). When the proximal ends 44*a* are received by the slots 32*b*, a cover element 36 (FIG. 4) may be used to secure the proximal ends 44*a* (and thus the arms of the frame) to the hub 32. Specifically, the cover element 36 is configured to inhibit the proximal ends 44*a* of the arms 44 (and thus the frame) from moving relative to the hub 32, i.e., to maintain the arms 44 in a fixed position. In some embodiments, it is contemplated that the cover element 36 may be fastened to the hub 32 by a fastening element. Specifically, the cover element 36 may be snapped onto the hub 32 (e.g., via resilient clips 36*a* or snaps) or fastened thereto (via removable fasteners, screws, nuts, bolts, etc.).

Figure 13:
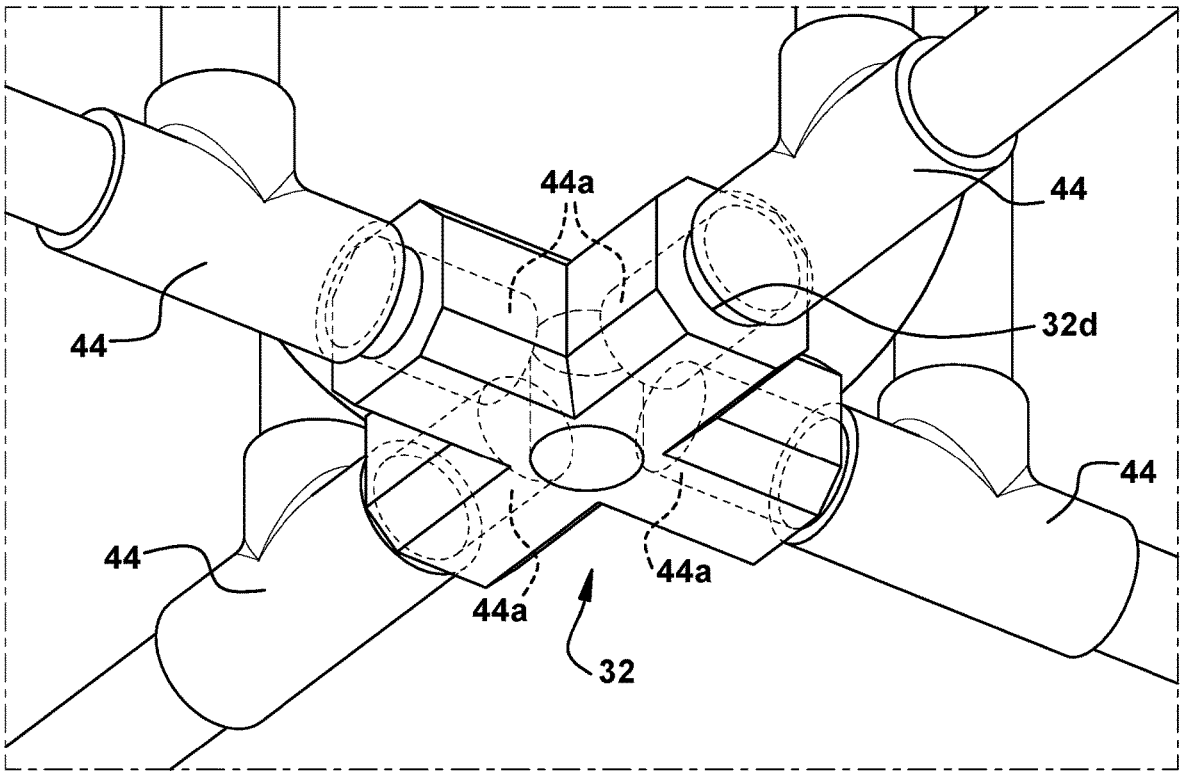
FIG. 13 is a representation of a hub of the throwing game assembly of an alternative embodiment with the hub shown as transparent for clarity.

In the illustrated example, each slot 32*b* embodies a concave seat conforming to an exterior shape of a respective proximal end 44*a*. However, it is contemplated that the slots 32*b* may take on different shapes and forms, for example, a square-shaped slot 32*b* that cooperates with a square-shaped proximal end 32*b*. In other embodiments, it is contemplated that the hub 32 may define blind holes 32*d* (see, e.g., FIG. 13) for receiving the proximal ends 44*a* of the arms 44. In such embodiments, each proximal end 44*a* may be snapped into the hub (e.g., via resilient snaps or clips) or dimensioned to be slip-fitted into the blind holes to resist movement. It is also contemplated that the hub 32 may define openings for receiving hooks extending from proximal ends 44*a* of the arms 44. Moreover, it is contemplated that the number of slots 32*b* may differ from that shown, for example, but not limited to, one slot for supporting a single cantilevered arm, or three slots for supporting three arms.

Still referring to FIG. 3, the frame 40 includes a plurality of arms 44 that extend radially from an upper end of the stand (i.e., from the hub 32 when secured thereto). In the present example, there are four arms 44 spaced relative to each other by 90° (when viewed along the z-axis). It is contemplated that the number of arms (and spacing thereof) may differ from that shown, for example, two or three arms or greater than four arms.

Each arm 44 includes a plurality of projections or tines 46 extending upwardly therefrom. Each tine 46 is configured to support a portion or segment of a respective hoop of the hoop assembly 100 (FIG. 6), as discussed in detail below. In the illustrated example (FIG. 3), there are three tines 46 projecting upwardly from each arm 44. The number of tines 46 may differ from that shown, for example, two tines (for supporting two hoops) or more than three tines (for supporting more than three hoops). The number of tines on each arm may correlate with the number of hoops. In other embodiments, there may be fewer tines than hoops and the hoops may be interconnected amongst themselves.

Referring to FIG. 4, each tine 46 extends in a direction substantially orthogonal with a horizontal portion 44*b*. Each tine 46 has an upper end 46*a* configured to be received within a mating retainer 82 (FIG. 5) that is attached to and/or extended from a lower surface of a hoop (or a segment thereof).

Figure 5:
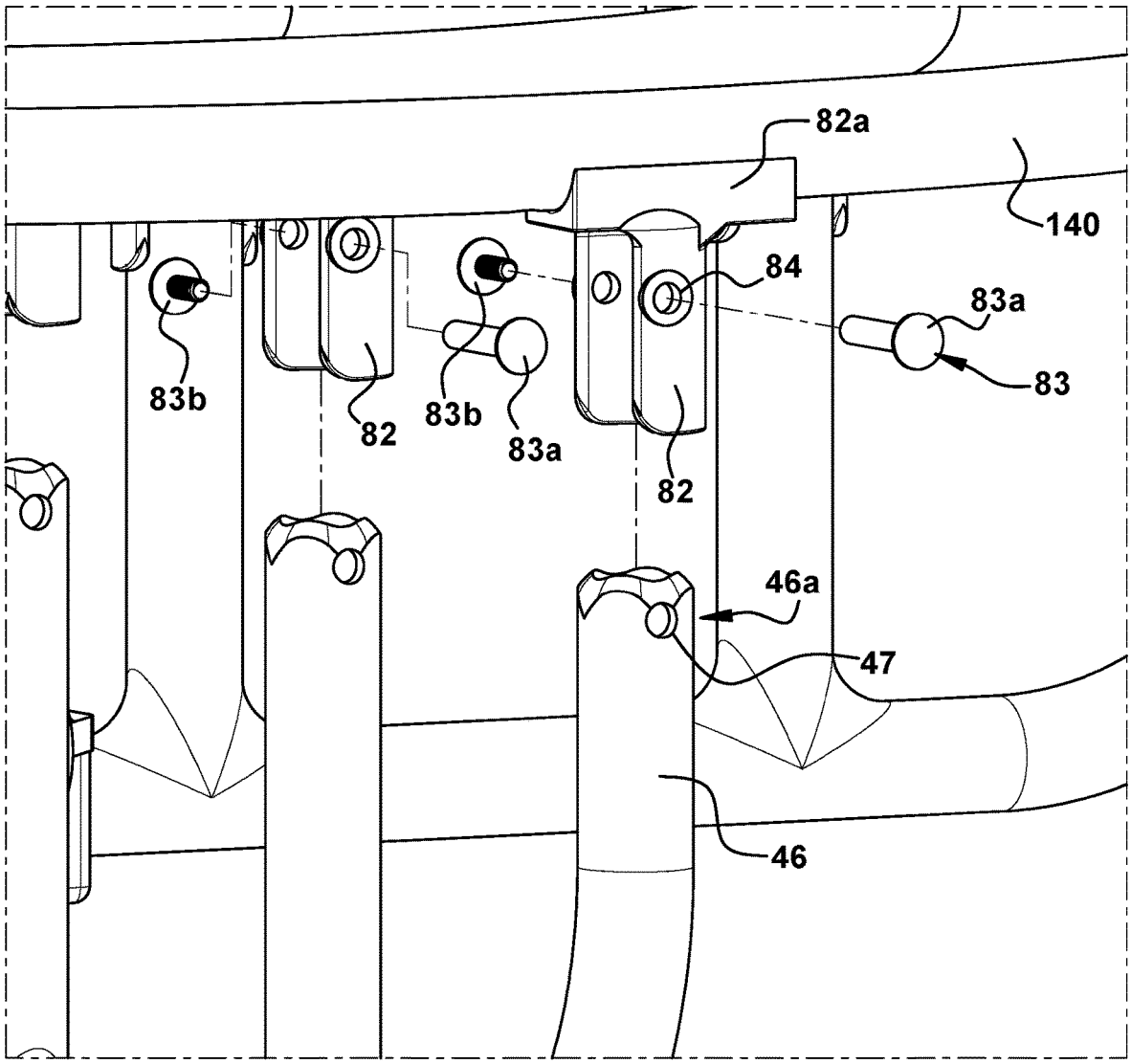
FIG. 5 is a closeup, exploded view of an arm shown in relation to a retainer.

As seen in FIG. 5, the mating retainer 82 includes a hoop attachment portion 82*a* extending upward from an upper portion thereof. The hoop attachment portion 82*a* is removably attached or fixed to a lower surface of a respective hoop by attachment members such as screws, rivets, or snaps. These attachment members may be fixed, or the attachment members may be removable for the case of storage.

In the illustrated example, the retainer 82 embodies a hollow partial cylinder. The retainer 82 includes a through hole 84 dimensioned to receive at least one fastener 83 that is also extended through a corresponding opening 47 of the end 46*a* to secure the hoop (140 in the illustrated example) to the tine 46. Preferably, the fastener 83 embodies a shoulder screw having a first part 83*a* and a second part 83*b*, the fastener 83 adapted to enable the tine 46 to rotate relative to the retainer 82. In this manner, each retainer 82 defines a pivot for allowing a respective arm to rotate between an extended position (see, e.g., FIG. 6—when it is desired to play a throwing game) or a collapsed position (see, e.g., FIG. 7—when it is desired to store the frame 40 and the hoop assembly 100, for example, in a sleeve or a bag).

Figure 8:
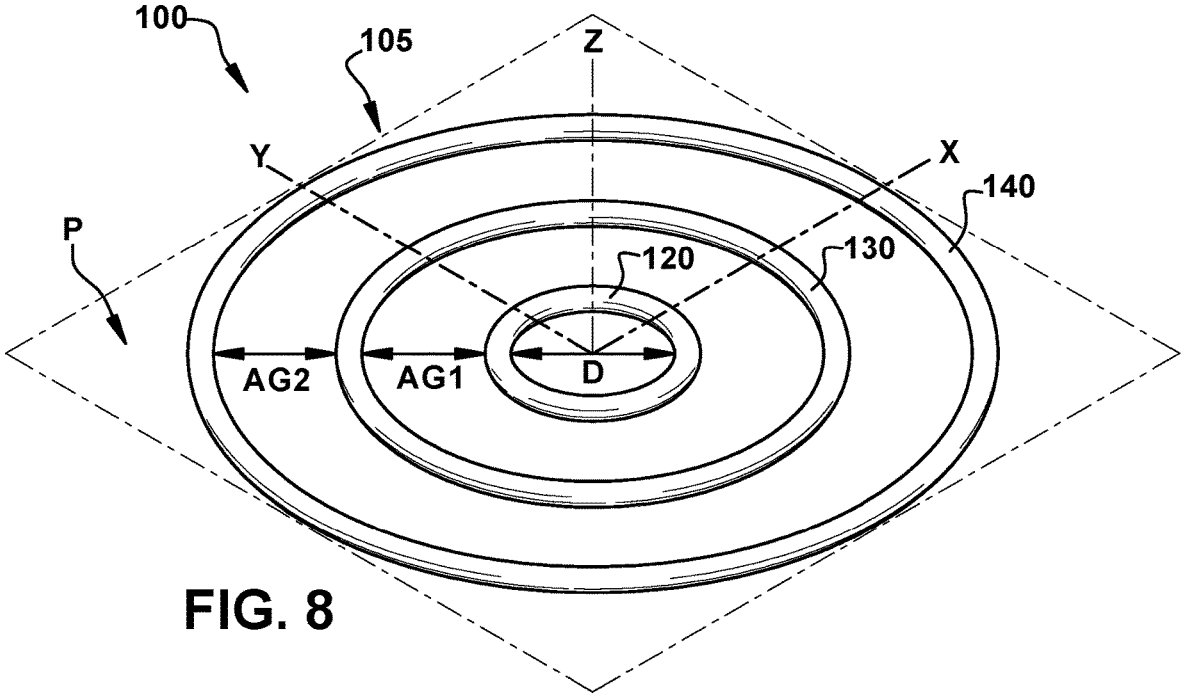
FIG. 8 is a perspective view of the hoop assembly shown in relation to a plane P.

Turning to FIG. 8, the hoop assembly 100 includes a plurality of hoops 105 (e.g., first, second, and third hoops 120, 130, and 140) spaced concentrically relative to a common axis, e.g., the z-axis in the embodiment shown. The plurality of hoops 105 may include fewer than or more than three hoops. For example, the plurality of hoops 105 may include four hoops. Preferably, the plurality of hoops 105 includes three hoops, a first hoop 120, a second hoop 130, and a third hoop 140. Preferably, the plurality of hoops 105 are substantially coplanar and disposed in a plane P defined by orthogonal axes x and y. In such embodiments, the plane P is substantially co-planar with the support surface (e.g., the ground, a floor, etc.). This arrangement is particularly beneficial for making the throwing game a skill-based game, wherein a player's skill level (throwing accuracy and corresponding trajectory) determines a scoring outcome. This is in distinction to embodiments wherein each hoop is vertically tiered relative to another, visually obscuring rear portions of scoring zones and adding an element of chance as to where (which hoop/scoring zone) a tossed projectile will land. Yet, in other embodiments, the plurality of hoops may be disposed in a plane that is inclined relative to the support surface, for example, by 3 to 15 degrees, and preferably 5 degrees relative to thereto. In such embodiments, it is contemplated that the stand may include a pivot (e.g., a swivel, a ball and socket joint) at a top thereof allowing the inclination of the hoop assembly 100 relative to the support surface to be changed by the user, and locked in place (e.g., by clamping the socket to the ball).

The hoop assembly 100 is also dimensioned such that the diameter of the third hoop 140 (i.e., the outer hoop) is between 20 and 40 inches, more preferably between 25 and 35 inches, and even more preferably 26 inches. The diameter of the second hoop 130 (i.e., the middle hoop) is between 10 and 20 inches, more preferably between 14 and 18 inches, and even more preferably 16 inches. The diameter of the first hoop 120 (i.e., the inner hoop) is between 3 and 10 inches, more preferably between 5 and 8 inches, and even more preferably 6 inches. Moreover, the spacing between the hoops 120, 130, and 140 and the diameter of the first hoop 120 may be dimensioned to make the concentric arrangement of the hoops 120, 130, and 140 look more uniform and a throwing game more engaging with respect to the diameter of the projectile being thrown. Specifically, the first hoop 120 and the second hoop 130 define a first annular gap AG1 therebetween, and the second hoop 130 and the third hoop 140 define a second annular gap AG2 therebetween when viewed along the z-axis (plan view). In the present example, each of the first and second annular gaps AG1, AG2 is between 3 and 5 inches, preferably 4 inches. The first and second annular gaps AG1, AG2 and a diameter D of the first hoop 120 (inner hoop) are dimensioned such that the diameter D is larger than each of the respective annular gaps AG1, AG2. In such embodiments, the diameter D of the first hoop 120 is two times a projectile diameter (e.g., a ball, a tossing sack, or bean bag diameter), and each of the first and second annular gaps AG1, AG2 is equal to 1.5 times the projectile diameter. In such embodiments, the projectile diameter is between 2 and 3 inches, and preferably 2.5 inches. The projectile may have a diameter larger than 3 inches, but be deformable (i.e., bean bag) so that the projectile can still easily pass through the hoops.

In other embodiments, each of the first and second annular gaps AG1, AG2 is equal to 60-80% of the diameter D of the first hoop 120. As noted above, this arrangement is adds uniformity to the concentric arrangement of the hoops and makes a throwing game more engaging with respect to the diameter of the projectile being thrown. In particular, the diameter D of the first hoop and the first and second annular gaps AG1, AG2 make the throwing game a skill-based game. The diameter D of the first hoop and the respective annular gaps AG1, AG2 are large enough to allow a projectile to enter a respective scoring zone, while requiring skill to throw the projectile in a manner such that it lands therein.

Yet in other embodiments, the relevant dimensions may be as follows:

- The diameter of the projectile is 2-3 inches.
- The distance D is 5-6" (substantially double the projectile diameter),
- The first and second gaps AG1 and AG2 are each 3-5" (1.5 times the diameter of the projectile)
- The outer hoop diameter (to its centerline) is 25-26". This would make the 3rd hoop inner diameter 24-25" and the outer diameter 26-27".
- The middle hoop diameter (to its centerline) is 15-16". That would make the 2nd hoop inner diameter 14-15" and the outer diameter 16-17"
- The inner hoop diameter (to its centerline) is 6". That would make the 1st hoop inner diameter 5-6" and the outer diameter 6.5-7.5".

Figure 6:
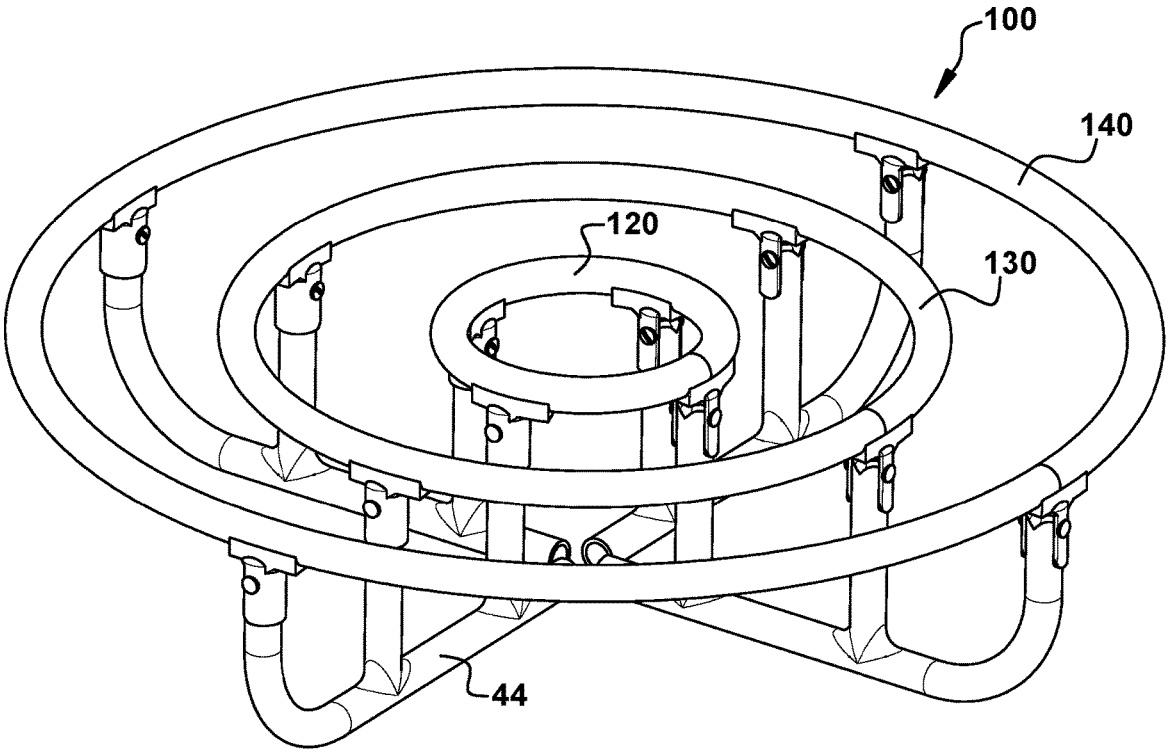
FIG. 6 is a perspective view of the frame arms pivotally connected to a hoop assembly, with the arms shown in an extended, vertical position.
Figure 7:
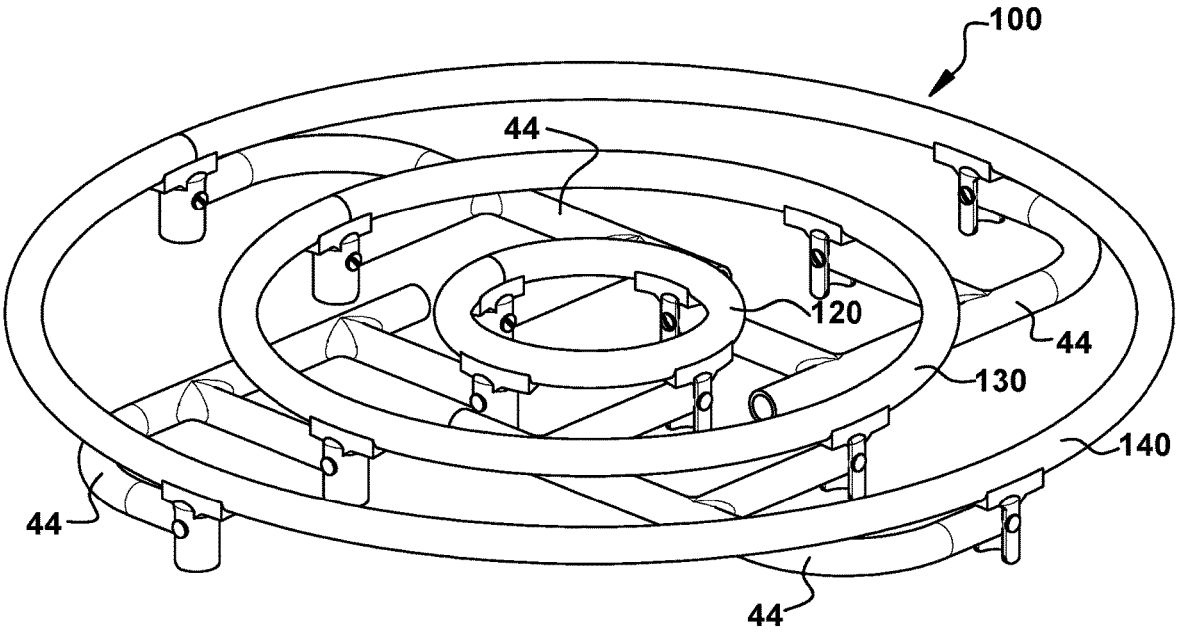
FIG. 7 is a perspective view of the frame arms pivotally connected to the hoop assembly, with the arms shown in a collapsed, horizontal position.

Each hoop 120, 130, and 140 (FIG. 8) is comprised of at least one piece. As illustrated in FIG. 8, each hoop 120, 130, 140 is formed by one continuous tubular piece. Each hoop 120, 130, 140 is adapted to be attached to and supported by an arm 44 (FIG. 6). Each hoop 120, 130, 140 is further adapted to support (e.g., suspend) a scoring receptacle 200 (FIG. 9) of the hoop assembly 100 therefrom. For this purpose, as illustrated in FIG. 10, each hoop 120, 130, and 140 may define an annular slot 121, 131, and 141 (FIG. 11) formed on a lower surface thereof dimensioned to receive upper ends 220, 230, and 240 (FIG. 9) of the scoring receptacle 200.

It is contemplated that in some embodiments, instead of a continuous tubular piece, the hoop assembly 100 may comprise a plurality of arc-shaped, tubular segments connected via couplers therebetween and forming a circle when connected. For example, in an embodiment where there are three arms 44, the first hoop 120 may comprise three tubular segments the second hoop 130 may comprise three tubular segments, and the third hoop 140 may comprise three tubular segments. However, it is contemplated that the number of segments may differ from that described, for example, less than or greater than three segments corresponding with less than or greater than three arms. In other embodiments, the tubular pieces or segments may not be tubular but may in fact have any other dimensional shape, such as a flat or substantially flat shape, a hexagonal shape, a rectangular shape, etc. Regardless of their dimensional shape or whether they are segments or continuous, the components comprising the hoop assembly 100 serve as a support for the scoring receptacle 200.

It is contemplated that each coupler and retainer 82 form part of a unitary structure (i.e., a hybrid connector) configured to connect the hoop assembly 100 to the frame 40 (FIG. 3) and connect the tubular segments of the hoop assembly 100 together. In other embodiments, it is contemplated that the retainer and coupler will be separate components that are connected via suitable attachment means, for example, via removable fasteners, resilient snaps, clips, etc. It is also contemplated that each hoop may be unpartitioned (obviating the need for couplers) such that only a retainer will be provided to connect the hoop assembly 100 to the frame, e.g., via removable fasteners, resilient snaps, clips, or any other suitable form of attachment means described herein. It is also contemplated that the retainers 82 may be integrally formed with the hoops.

Figure 12:
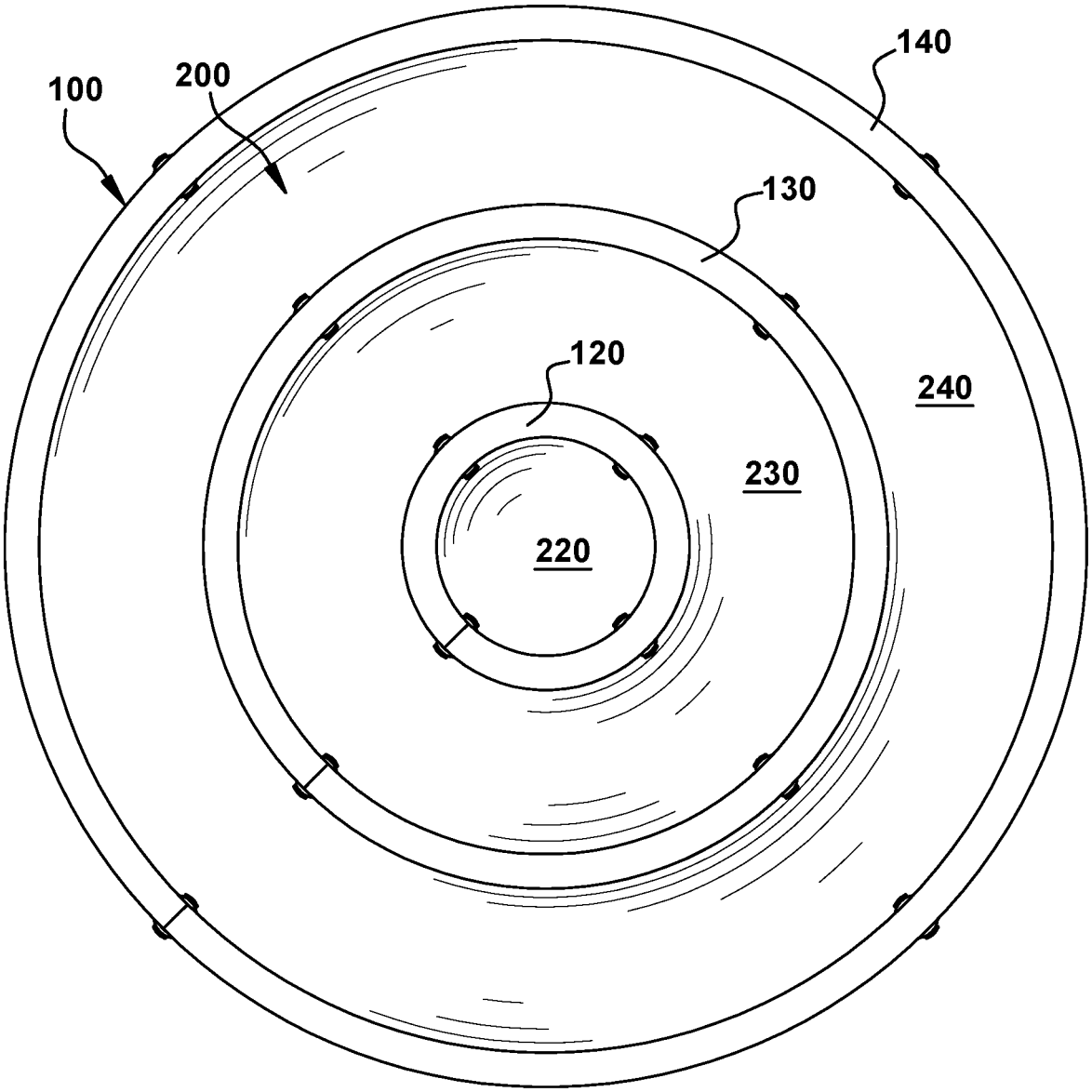
FIG. 12 is a top view of the hoop assembly.

Turning to FIG. 12, the scoring receptacle 200 includes a plurality of scoring zones 220, 230, and 240 adapted to receive projectiles therein. Specifically, the scoring zones 220, 230, and 240 are demarcated by the hoops 120, 130, and 140 of the hoop assembly 100. For example, the first hoop 120 demarcates a first scoring zone 220, the first and second hoops 120 and 130 demarcate a second scoring zone 230, and the second and third hoops 130 and 140 demarcate a third scoring zone 240. As discussed above, the plurality of hoops 105 within the hoop assembly 100 may include fewer than or more than three hoops, and therefore a number of scoring zones 220, 230, 240 correspond to a number of hoops of the plurality of hoops 105.

Because the frame 40 (FIG. 2) is disposed underneath the hoop assembly 100, the respective scoring zones 220, 230, and 240 are unobstructed by the constituent members of the frame (e.g., the arms or tines thereof). Advantageously, this permits each scoring zone to be continuous (along an entire circumference thereof) such that a projectile (e.g., a bag or ball) advancing into a scoring zone is not deflected by a member of the frame protruding into the scoring zone. This aspect of the present disclosure removes an element of chance that a frame member will undesirably preclude the projectile from landing in the scoring zone.

Figure 9:
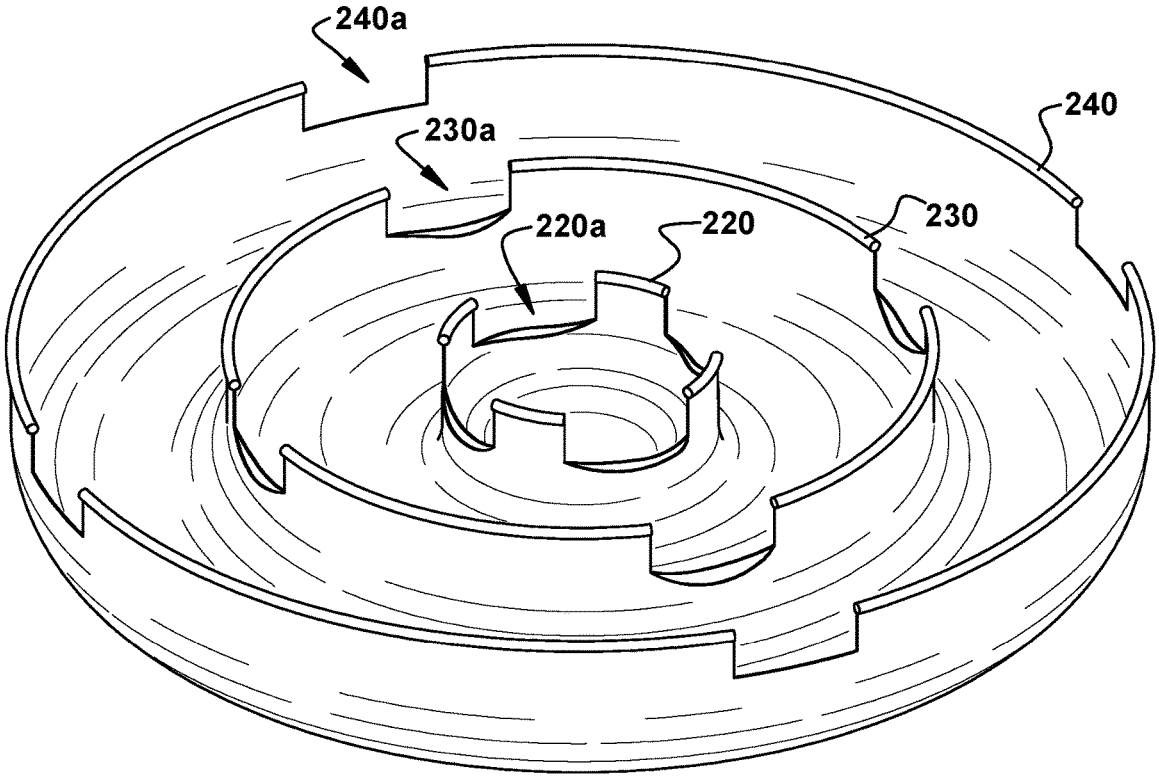
FIG. 9 is a top perspective view of a scoring receptacle of the throwing game assembly.
Figure 10:
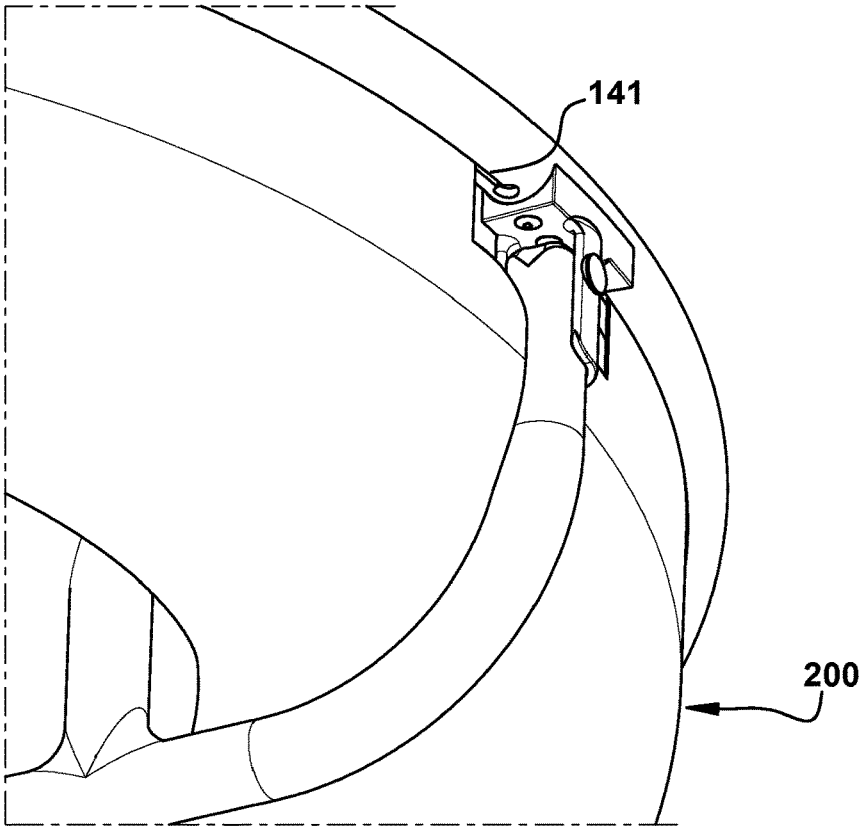
FIG. 10 is a closeup view of the hoop assembly of FIG. 6.
Figure 11:
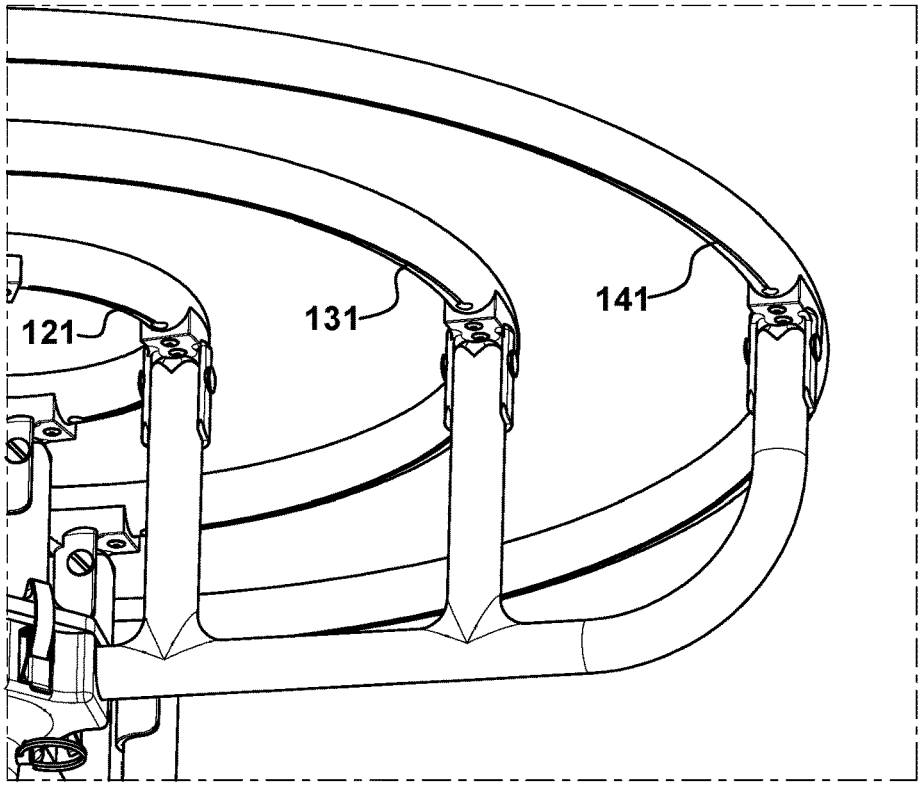
FIG. 11 is a partial, bottom perspective view of an outer hoop of the hoop assembly.

Referring to FIGS. 9-11, the scoring receptacle 200 may be attached to the hoop assembly 100 by inserting the upper ends of the 220, 230, and 240 (FIG. 9) of the scoring receptacle 200 into the annular slots 121, 131, 141 all the way around the hoop assembly 100. The scoring receptacle 200 (FIG. 9) may define openings or cutaways 220*a*, 230*a*, and 240*a* permitting the user to make the foregoing connection around the retainers 82.

However, as noted above, it is contemplated that the scoring receptacle 200 may be connected to the hoop assembly 100 via other suitable attachment means, for example, but not limited to, resilient clips, snaps, hook and loop fasteners, magnets, etc.

An example method of game play will now be described. In general, the method of game play includes providing a pair of throwing game assemblies 10 spaced apart by a length therebetween. In a preferred embodiment, the length is between five and thirty feet, more preferably between ten and twenty feet. In one aspect, the length may be fourteen feet. However, it is contemplated that the length may be different in other embodiments and may be changed depending on the skill level of the players.

The preferred method of game play also includes providing throwing projectiles to two players or two teams. Throwing projectiles may take a variety of forms, for example, bean bags filled with beads, weighted inflatable balls, etc. It is contemplated that type and the number of projectiles may vary.

The method of game play also includes assigning one or more players to teams. In a preferred embodiment, there are two teams each comprising two players (i.e., teammates). Each player of a respective team stands next to a throwing game assembly 10, and the teammate of that player stands next to a throwing game assembly 10 located across from the player such that the teammates are standing across from each other.

The method of game play also includes commencing a throwing game wherein players from each team take turns throwing or tossing the projectile towards a hoop assembly 100 with the objective of landing the projectile in one of the three scoring zones (e.g., 220, 230, and 240 in FIG. 12), and preferably in the center most scoring zone (e.g., 220 in FIG. 12). The method of game play may also include game rules accrediting a team with points when a projectile lands in a scoring zone. For example, a projectile landing in the first or center most scoring zone 220 may be accredited with more points (e.g., 3 points) than a projectile landing in the second scoring zone 230, and a projectile landing in the second scoring zone 230 may be accredited with more points (e.g., 2 points) than a projectile landing in the third scoring zone 240 (e.g. 1 point). The game rules may also enable players on a respective team standing next to a throwing game assembly 10 to catch a projectile bouncing off the hoop assembly 100 to keep the projectile in play. The game rules also may stipulate those projectiles not landing in any of the respective scoring zones are awarded no points.

At the end of each round (e.g., after a player on both teams have thrown or tossed a predetermined number of projectiles towards a throwing game assembly 10), a score may be determined by tallying the points scored for each team and deducting points from the lower scoring team from the higher scoring team to derive a total point value accredited to the higher scoring team for the round. The game rules may also define a total point threshold, that defines the total point value necessary to win the game, for example, 21 points. Alternatively, the game may end after a predetermined number of rounds, for example three to five rounds, with the player or team having the most points being the winning player or team.

In other embodiments, the method of game play may include setting up a single throwing game assembly 10 (as opposed to two) for accommodating individual game play, wherein a single player throws projectiles toward the throwing game assembly 10 to accumulate points. It is also contemplated that two or more players may take turns throwing projectiles toward a single throwing game assembly 10 or towards a pair of throwing game assemblies 10 to accumulate points, whereupon the winner is determined based on the number of total points accumulated relative to a threshold. In some embodiments, it is contemplated that the method of game play may be implemented in software, wherein players in different geographical locations can play a simulated version of the throwing game utilizing a computer-generated throwing game assembly. In some embodiments, it is contemplated that the throwing game assembly 10 may be adapted for use in the water, for example, by a buoyancy block or inflatable structure. It is also contemplated that the size of the throwing game assembly 10 may be adapted for table top games, for example, using ping pong balls and the like.

While the various inventions disclosed herein have been described with reference to the example embodiments described above, it should be understood that modifications and alterations will occur to others upon a reading and understanding of this specification without departing from the spirit and scope of the invention set forth in the appended claims. Example embodiments incorporating one or more aspects of the invention are intended to include all such modifications and alterations insofar as they come within the scope of the appended claims and their equivalents. In this manner, it is contemplated that aspects of one embodiment may be combined with another.

Moreover, it should be understood that the order of discussion is not limiting and is only provided for ease of describing the various examples of a throwing game assembly 10 and method of game play disclosed herein. Similarly, the positions or orientations (e.g., upper, lower, left, right, bottom) described herein are provided for case of disclosing the illustrated embodiments. In this manner, it should be appreciated that positions may be different in other embodiments without departing from the scope of the present disclosure.

The invention claimed is:

1. A game assembly for a tossing game comprising:

a stand having a first end adapted to rest on a support surface, the stand having a stand axis;

a frame attached to a second end of the stand opposite the first end, said frame including a plurality of arms extending radially from the second end, wherein each of the plurality of arms includes a plurality of tines extending longitudinally therefrom away from the stand;

a hub configured to connect the frame to the stand;

a hoop assembly including a plurality of hoops spaced concentrically around and perpendicular to the stand axis, and a scoring receptacle including at least one annular scoring zone continuous along a circumference thereof, wherein each of the plurality of hoops is attached to a respective one of the plurality of tines, and wherein the plurality of hoops is adapted to suspend the scoring receptacle therefrom.

2. The game assembly according to claim 1, wherein the plurality of hoops comprises a first hoop and a second hoop defining a first annular gap therebetween, the first hoop being an innermost hoop, wherein the first hoop defines a diameter, wherein the diameter of the first hoop is greater than a radial width of the first annular gap.

3. The game assembly according to claim 2, wherein the diameter of the first hoop comprises a first dimension, and wherein the first annular gap comprises a second dimension that is at least 60 to 80% of the first dimension.

4. The game assembly according to claim 1, wherein each of the plurality of arms is spaced from an adjacent arm of the plurality of arms by 90° or 120° when viewed along the stand axis.

5. The game assembly according to claim 1, wherein each of the plurality of tines is pivotally connected to a respective one of the plurality of hoops via a retainer.

6. The game assembly according to claim 5, wherein each retainer is configured to receive an upper end of a respective one of each of the plurality of tines.

7. The game assembly according to claim 1, wherein the scoring receptacle comprises a pliable material selected from the group consisting of a net, a mesh, or a fabric material.

8. The game assembly according to claim 1, wherein the stand comprises a first telescoping member and a second telescoping member configured to be received by the first telescoping member to adjust a vertical position of the hoop assembly.

9. The game assembly according to claim 8, wherein the hub includes a hole aligned with an indentation formed in an upper end of the first telescoping member.

10. The game assembly according to claim 9, wherein a pin is configured to be inserted into the hole within the hub and abut against the indentation formed in the upper end of the first telescoping member.

11. The game assembly according to claim 8, wherein an upper end of the first telescoping member includes a projection configured to be aligned with a notch formed in a blind hole of the hub.

12. The game assembly according to claim 1, wherein the hub defines a plurality of slots, each configured to receive a proximal end of one of each of the plurality of arms.

13. The game assembly according to claim 12, wherein a cover element is configured to inhibit the proximal end of each of the plurality of arms from moving relative to the hub.

14. The game assembly according to claim 13, wherein the cover element is attached to the hub by at least one fastening element.

15. A method of game play comprising:

providing a pair of game assemblies according to claim 1 and a plurality of throwing projectiles;

assigning one or more players to a first team;

assigning one or more players to a second team;

commencing a game wherein each of the first and second teams take turns throwing one of the plurality of throwing projectiles at a respective game assembly; and scoring points to determine a winner.

16. The method of game play according to claim 15, wherein each respective game assembly includes a plurality of scoring zones.

17. The method of game play according to claim 16, wherein throwing one of the plurality of throwing projectiles in an innermost scoring zone results in a number of points larger than throwing one of the plurality of throwing projectiles in any other scoring zone.

18. The method of game play according to claim 15, wherein the plurality of scoring zones are continuous annular regions formed by the plurality of hoops.

19. The method of game play according to claim 15, wherein the game consists of a series of rounds, wherein all of the plurality of throwing projectiles are thrown in each round.

20. The method of game play according to claim 15, wherein the plurality of projectiles are bean bags.

* * * * *